US005338321A

United States Patent [19]

Tachiki

[11] Patent Number: 5,338,321

[45] Date of Patent: Aug. 16, 1994

[54] GASOLINE-BLENDED METHANOL FUEL FOR INTERNAL COMBUSTION ENGINES

[75] Inventor: Kiyohiro Tachiki, Kanagawa, Japan

[73] Assignee: Mitsubishi Oil Co., Ltd., Tokyo, Japan

[21] Appl. No.: 10,768

[22] Filed: Jan. 29, 1993

[30] Foreign Application Priority Data

Jan. 31, 1992 [JP] Japan ..... 4-040516

[51] Int. Cl.[5] ..... C10L 1/02; C10L 1/04

[52] U.S. Cl. ..... 44/451; 208/16; 208/17

[58] Field of Search ..... 44/451; 208/16, 17

[56] References Cited

U.S. PATENT DOCUMENTS

| | | | |
|---|---|---|---|
| 1,578,201 | 3/1926 | Midgley, Jr. | 44/451 |
| 2,420,030 | 5/1947 | Brandon | 208/17 |
| 2,874,114 | 2/1959 | Ruedisulj | 208/17 |
| 2,875,145 | 2/1959 | Annable et al. | 208/17 |
| 2,888,394 | 5/1959 | Christensen et al. | 208/16 |
| 2,897,067 | 7/1959 | Sparks | 44/451 |
| 3,330,758 | 7/1961 | Simpson | 208/17 |
| 4,279,619 | 7/1981 | Tsuzuki et al. | 44/451 |
| 4,801,305 | 1/1989 | Muller et al. | 44/451 |

OTHER PUBLICATIONS

*Proceedings Fifth International Alcohol Fuel Technology Symposium,* vol. II, May 13–18, 1982; Auckland, New Zealand.

*Proceeding Communications,* vol. I, May 21–25, 1984; Ottawa, Canada.

*VIII International Symposium on Alcohol Fuels,* Nov. 13–16, 1988; Tokyo, Japan.

*Primary Examiner*—Margaret Medley

*Attorney, Agent, or Firm*—Sughrue, Mion, Zinn, Macpeak & Seas

[57] ABSTRACT

Disclosed is a fuel for Otto cycle internal combustion engines. The fuel comprises a blend of a gasoline (A) and methanol (B) in a ratio of 10:90 to 30:70 by volume, based on the total amount of (A) and (B). Gasoline (A) is obtained by the steps of, (i) hydrotreating heavy naphtha, (ii) catalytically reforming the hydrotreated heavy naphtha to obtain a catalytically reformed gasoline, (iii) distilling the reformed gasoline to divide the reformed gasoline into three fractions (1), (2) and (3) which fractions contain hydrocarbons having a carbon number of 5 and less, from 6 to 8, and 9 and more, respectively, and (iv) mixing the two fractions of (1) and (3) either in a ratio which is the same as that in which the two fractions were obtained by distillation or in a ratio of 30:70 to 90:10 based on the total volume amount of (1) and (3).

3 Claims, No Drawings

GASOLINE-BLENDED METHANOL FUEL FOR INTERNAL COMBUSTION ENGINES

FIELD OF THE INVENTION

The present invention relates to a fuel for internal combustion engines which is obtained by blending a specific gasoline with methanol in order to overcome the drawbacks of methanol as a substitute fuel for use in Otto cycle type internal combustion engines.

BACKGROUND OF THE INVENTION

Gasolines comprising petroleum hydrocarbons have been used for a long time as fuels for Otto cycle type internal combustion engines. However, the oil crises that occurred repeatedly in 1973 and 1979 led to investigations of various fuels to be used as petroleum substitutes. Of these, methanol is expected to be the most promising substitute fuel for use in Otto cycle type internal combustion engines. In the United States, methanol is also regarded as a promising measure against photochemical smog which is a serious cause of urban environmental pollution. For these reasons, experiments on methanol fuels are being made in various countries in the world including the United States and Japan.

However, methanol has the following drawbacks as indicated, for example, in *Proceedings of VIII International Symposium on Alcohol Fuels,* (Nov. 13–16, 1988, Tokyo), pp. 851–868:

(a) at low temperatures, methanol has poor engine-starting performance and may be unable to start the engine;

(b) if methanol catches fire in an accident, the flame is invisible and this is dangerous; and (c) in an enclosed state such as in a fuel tank, ordinary temperatures are within the combustion range for the gaseous phase and, hence there is the danger of fire or explosion.

As an expedient for overcoming these drawbacks, blending of methanol with around 15% by volume of a gasoline or the like is generally done. In this case, automotive gasolines on the general market, catalytically reformed gasolines, straight-run light naphthas, isopentane, and so forth are employed as the blending gasoline or the like.

Although blends of methanol with these gasolines or the like have the aforementioned inflammation-avoiding effect (c), blending components respectively have the following problems:

(1) automotive gasolines produce a low temperature starting-improving effect (a) and flame visibility-improving effect (b) (referring to the aforementioned drawbacks), but these effects are still insufficient. Further, there are cases where these improving effects are varied by a difference in production method or the lot of the gasolines;

(2) catalytically reformed gasolines are good in (b) but are still insufficient in (a);

(3) straight-run light naphthas are good in (a) but are still insufficient in (b); and (4) isopentane is good in (a) but is insufficient in (b). Further, it is expensive and is uneconomical.

SUMMARY OF THE INVENTION

An object of the present invention is to provide a gasoline-blended methanol fuel for internal combustion engines which eliminates the problems described above.

According to the present invention, a gasoline containing, as major components, (i) a light fraction which has been obtained from a gasoline base and contains hydrocarbons having a carbon number of 5 and less and which is effective for improving the aforementioned drawback (a), and (ii) a heavy fraction which has been enriched with aromatic hydrocarbons having 9 or more carbon atoms and is effective for improving the aforementioned drawback (b), is blended with methanol to overcome the problems. In this blended gasoline, the fractions of a catalytically reformed gasoline which are used are those that can be obtained economically at low cost without using a special purification method.

The present invention employs a gasoline (A) obtained by subjecting a heavy naphtha to hydrotreatment and then catalytically reforming it to obtain thereby a catalytically reformed gasoline, distilling the reformed gasoline to divide it into three fractions (1), (2), and (3) containing hydrocarbons which have a carbon number of 5 and less, from 6 to 8, and 9 and more, respectively, and mixing the two fractions of (1) and (3). In this gasoline (A), the proportions of fractions (1) and (3) are either the same as the proportions in which the two fractions were obtained by the distillation, or in a ratio of 30:70 to 90:10 based on the total volume amount of (1) and (3). A blend of the thus-obtained gasoline (A) and methanol (B) in a ratio of 10:90 to 30:70 based on the total volume amount of (A) and (B) is provided by the present invention as a fuel for Otto cycle type internal combustion engines.

DETAILED DESCRIPTION OF THE INVENTION

As the heavy naphtha for use as the raw material to be catalytically reformed for producing the fuel of the present invention, a straight-run heavy naphtha or a catalytically-cracked heavy naphtha can be used after being subjected to hydrotreatment. The catalytic reforming of the heavy naphtha may be conducted by either a fixed catalyst bed method or a moving catalyst bed method.

The heavy naphtha, after being hydrotreated, is treated with a noble metal catalyst such as platinum in the presence of hydrogen under conditions of a temperature of 450 to 530° C. and a pressure of from 5 to 50 atm. Thus, a so-called catalytically reformed gasoline is obtained which has an aromatic content of from 40 to 70% by volume (based on the total hydrocarbon content) and a boiling point range of from 30 to 200° C.

Since the thus-obtained gasoline contains aromatics in a large amount, it is extremely high in octane number and hence is utilized as a base for automotive gasolines. This gasoline is utilized also in the production of benzene, toluene, xylene, and so forth as petrochemical raw materials. For the latter application, the catalytically reformed gasoline is divided by distillation into three fractions (1), (2), and (3) which contain hydrocarbons having a carbon number of 5 and less, from 6 to 8, and 9 and more, respectively. Fraction (2) is subjected to extraction and precise distillation to produce benzene, toluene, and xylene, with the two fractions (1) and (3) being by-products.

The present invention provides a fuel for Otto cycle type internal combustion engines which comprises a blend of a gasoline (A) obtained by mixing the above-described two fractions (1) and (3) with methanol (B) in a ratio of 10:90 to 30:70 based on the total volume amount of (A) and (B).

In this fuel, the proportion of the gasoline should be 10% by volume or more from the standpoint of the low temperature starting-improving effect (a) and the flame visibility-improving effect (b). If the gasoline proportion is less than 10% by volume, these effects cannot be sufficiently improved upon. It should, however, be noted that although larger gasoline proportions do not adversely affect these effects, fuels having too high a gasoline content are of less importance as a gasoline substitute and may be economically disadvantageous, Therefore, a practical range of the proportion of the gasoline (A) may be up to about 30% by volume based on the total volume amount of (A) and (B).

In the gasoline (A), the proportions of fractions (1) and (3) are either the same as the proportions in which the two fractions were obtained by distillation, or in a ratio of 30:70 to 90:10 based on the total volume amount of (1) and (3).

Further, a gasoline (A') obtained by mixing an ordinary automotive gasoline base with gasoline (A) in a proportion of 30:70 by volume or less may be blended with methanol (B) in a ratio of 10:90 to 30:70 based on the total volume amount of (A') and (B), to give a fuel for Otto cycle type internal combustion engines. The mixing of an ordinary automotive gasoline may reduce improvement for effects (a) and (b), but these inventive effectivenesses remain until the upper additional limit of an ordinary automotive gasoline.

The reasons for the use of fractions (1) and (3) but not fraction (2) in the present invention are that fraction (1) is effective in improving the low temperature starting-improving effect (a) because it is a light fraction, and that fraction (3) is effective in improving the flame visibility-improving effect (b) by the time the methanol fuel burns out because fraction (3) contains a large amount of aromatic hydrocarbons and is high in boiling point. Fraction (2), although improving to a certain degree effects (a) and (b), is inferior to a combination of fractions (1) and (3) for these effects.

A characteristic feature of the present invention resides in that particularly effective fractions only are used as described above, so that the gasoline produces better effects than conventional gasolines.

Further, the reason for the limitation on the proportions of fractions (1) and (3), which are either the same as the proportions in which the two fractions were obtained by distillation or in a ratio of 30:70 to 90:10 based on the total volume amount of (1) and (3), is that proportions thereof outside these ranges result in less improvement for effects (a) and (b).

Furthermore, the reason for the limitation on the composition of gasoline (A') in the present invention, which is one obtained by mixing an ordinary automotive gasoline base with a gasoline (A) in a proportion of 30:70 by volume or less, is that ordinary automotive gasoline proportions above this range result in less improvement of effects (a) and (b).

The present invention is characterized in that either a gasoline (A) obtained by mixing the above-described two fractions of (1) and (3) or a gasoline (A') obtained by mixing an automotive gasoline base with the gasoline (A) in a proportion of 30:70 by voluble or less is blended with methanol.

Fraction (1) contains, as major components, paraffinic hydrocarbons having from 4 to 5 carbon atoms and, hence, is low in boiling point and is volatile. Therefore, blending this fraction with methanol significantly improves the low temperature-starting performance of methanol (effect (a)).

Fraction (3) contains, as major components, aromatic hydrocarbons having 9 or more carbon atoms and is high in boiling point, so that it is effective in keeping methanol fuel flames bright until the fuel burns out. Therefore, blending of this fraction with methanol significantly improves the visibility of methanol flames (effect (b)).

As described above, by blending either a gasoline (A) obtained by mixing the two fractions of (1) and (3) or a gasoline (A') containing the gasoline (A) as the major component with methanol (B) in a ratio of 10:90 to 30:70, the present invention can bring about the remarkable effect of improving both of the aforementioned drawbacks (a) and (b) associated with methanol to a higher degree as compared with conventional techniques.

The present invention will be explained below in more detail with reference to the following examples, but the invention is not construed as being limited thereto.

EXAMPLES

Examples and Comparative Examples are summarized in Tables 1 and 2, respectively.

EXAMPLE 1

Example 1 shows the most preferred embodiment of the fuel of the present invention. A straight-run heavy naphtha was hydrotreated and then treated by a catalytic reforming method of the moving catalyst bed type. The thus-obtained catalytically reformed gasoline was divided by distillation into three fractions of (1), (2), and (3) which contained hydrocarbons having a carbon number of 5 and less, from 6 to 8, and 9 and more, respectively. Fractions (1) and (3) were then mixed with each other in amounts of 60% by volume and 40% by volume, respectively, to prepare a catalytically reformed gasoline distillate. This catalytically reformed gasoline distillate was blended with methanol in a proportion of 15% by volume.

The catalytically reformed gasoline distillate used for preparing the gasoline-blended methanol fuel had fraction proportions such that the proportion of the fraction of $C_5$ and less which is closely related to the low temperature starting-improving effect was 57% by volume and the proportion of the fraction of $C_9$ and more which is closely related to the flame visibility-improving effect was 40% by volume. With respect to the hydrocarbon composition of the distillate, the content of aromatics which are closely related to the flame visibility-improving effect like the fraction of $C_9$ and more was 39% by volume.

This gasoline-blended methanol fuel was evaluated for its low temperature starting-improving effect and flame visibility-improving effect. A sufficient improvement was observed in each item.

EXAMPLE 2

Fractions (1) and (3) were mixed with each other in amounts of 35% by volume and 65% by volume, respectively, to prepare a catalytically reformed gasoline distillate. This catalytically reformed gasoline distillate was blended with methanol in a proportion of 15% by volume.

The catalytically reformed gasoline distillate used for preparing the gasoline-blended methanol fuel had fraction proportions such that the proportion of the fraction of $C_5$ and less was 33% by volume and the proportion of the fraction of $C_9$ and more was 65% by volume. With respect to the hydrocarbon composition of the distillate, the content of aromatics was 63% by volume.

This gasoline-blended methanol fuel was evaluated for its low temperature starting-improving effect and flame visibility-improving effect. An almost satisfactory improvement was observed for low temperature starting and a significant improvement was observed for flame visibility.

EXAMPLE 3

Fractions (1) and (3) were mixed with each other in amounts of 85% by volume and 15% by volume, respectively, to prepare a catalytically reformed gasoline distillate. This catalytically reformed gasoline distillate was blended with methanol in a proportion of 15% by volume.

The catalytically reformed gasoline distillate used for preparing the gasoline-blended methanol fuel had fraction proportions such that the proportion of the fraction of $C_5$ and less was 81% by volume and the proportion of the fraction of $C_9$ and more was 15% by volume. With respect to the hydrocarbon composition of the distillate, the content of aromatics was 15% by volume.

This gasoline-blended methanol fuel was evaluated for its low temperature starting-improving effect and flame visibility-improving effect. A significant improvement was observed for low temperature starting and an almost satisfactory improvement was observed for flame visibility.

EXAMPLE 4

Fractions (1) and (3) were mixed with each other in amounts of 60% by volume and 40% by volume, respectively, to prepare a catalytically reformed gasoline distillate. This catalytically reformed gasoline distillate was blended with methanol in a proportion of 12% by volume.

The catalytically reformed gasoline distillate used for preparing the gasoline-blended methanol fuel had fraction proportions such that the proportion of the fraction of $C_5$ and less was 57% by volume and the proportion of the fraction of $C_9$ and more was 40% by volume. With respect to the hydrocarbon composition of the distillate, the content of aromatics was 39% by volume. This gasoline-blended methanol fuel was evaluated for its low temperature starting and flame visibility. A sufficient improvement was observed for each item.

EXAMPLE 5

Fractions (1) and (3) were mixed with each other in amounts of 60% by volume and 40% by volume, respectively, to prepare a catalytically reformed gasoline distillate. This catalytically reformed gasoline distillate was blended with methanol in a proportion of 30% by volume.

The catalytically reformed gasoline distillate used for preparing the gasoline-blended methanol fuel had fraction proportions such that the proportion of the fraction of $C_5$ and less was 57% by volume and the proportion of the fraction of $C_9$ and more was 40% by volume. With respect to the hydrocarbon composition of the distillate, the content of aromatics was 39% by volume. This gasoline-blended methanol fuel was evaluated for its low temperature starting-improving effect and flame visibility-improving effect. A sufficient improvement was observed for each item.

EXAMPLE 6

An ordinary automotive gasoline (regular gasoline on the market) was mixed in an amount of 25% by volume with the catalytically reformed gasoline distillate obtained in Example 1, to prepare a gasoline distillate. This gasoline distillate was blended with methanol in a proportion of 15% by volume.

The gasoline distillate used for preparing the gasoline-blended methanol fuel had fraction proportions such that the proportion of the fraction of $C_5$ and less was 49% by volume and the proportion of the fraction of $C_9$ and more was 35% by volume. With respect to the hydrocarbon composition of the distillate, the content of aromatics was 37% by volume.

This gasoline-blended methanol fuel was evaluated for its low temperature starting-improving effect and flame visibility-improving effect. A sufficient improvement was observed for each item.

COMPARATIVE EXAMPLE 1

An ordinary automotive gasoline (regular gasoline on the market) was blended with methanol in a proportion of 15% by volume.

The gasoline distillate used for preparing the gasoline-blended methanol fuel had fraction proportions such that the proportion of the fraction of $C_5$ and less was 23% by volume and the proportion of the fraction of $C_9$ and more was 21% by volume. With respect to the hydrocarbon composition of the distillate, the content of aromatics was 29% by volume.

This gasoline-blended methanol fuel was evaluated for its low temperature starting-improving effect and flame visibility-improving effect. Although a certain degree of improvement was observed for each item, the fuel prepared above was less effective than the gasoline-blended methanol fuels according to the present invention.

COMPARATIVE EXAMPLE 2

A straight-run light naphtha was blended with methanol in a proportion of 15% by volume.

The gasoline distillate used for preparing the gasoline-blended methanol fuel had fraction proportions such that the proportion of the fraction of $C_5$ and less was 57% by volume, but the proportion of the fraction of $C_9$ and more was 1% by volume. With respect to the hydrocarbon composition of the distillate, the content of aromatics was 7% by volume.

This gasoline-blended methanol fuel was evaluated for its low temperature starting-improving effect and flame visibility-improving effect. The low temperature starting-improving effect was sufficiently improved, but the flame visibility-improvement was insufficient.

COMPARATIVE EXAMPLE 3

Fractions (1) and (3) obtained in Example 1 were mixed with each other in amounts of 25% by volume and 75% by volume, respectively, to prepare a catalytically reformed gasoline distillate. This catalytically reformed gasoline distillate was blended with methanol in a proportion of 15% by volume.

The catalytically reformed gasoline distillate used for preparing the gasoline-blended methanol fuel had fraction proportions such that the proportion of the fraction of $C_5$ and less was 24% by volume. On the other hand, the proportion of the fraction of $C_9$ more was 75% by volume. With respect to the hydrocarbon composition of the distillate, the content of aromatics was 73% by volume.

This gasoline-blended methanol fuel was evaluated for its low temperature starting-improving effect and flame visibility-improving effect. The flame visibility-improving effect was sufficiently improved, but the low temperature starting-improvement was insufficient.

COMPARATIVE EXAMPLE 4

Fractions (1) and (3) obtained in Example 1 were mixed with each other in amounts of 95% by volume and 5% by volume, respectively, to prepare a catalytically reformed gasoline distillate. This catalytically reformed gasoline distillate was blended with methanol in a proportion of 15% by volume.

The catalytically reformed gasoline distillate used for preparing the gasoline-blended methanol fuel had fraction proportions such that the proportion of the fraction of $C_5$ and less was 90% by volume and the proportion of the fraction of $C_9$ and more was 5% by volume. With respect to the hydrocarbon composition of the distillate, the content of aromatics was 5% by volume.

This gasoline-blended methanol fuel was evaluated for its low temperature starting-improving effect and flame visibility-improving effect. The low temperature starting-improving effect was sufficiently improved, but the flame visibility-improving effect was quite insufficient.

COMPARATIVE EXAMPLE 5

Fractions (1) and (3) obtained in Example 1 were mixed with each other in amounts of 60% by volume and 40% by volume, respectively, to prepare a catalytically reformed gasoline distillate. This catalytically reformed gasoline distillate was blended with methanol in a proportion of 8% by volume.

The gasoline distillate used for preparing the gasoline-blended methanol fuel had fraction proportions such that the proportion of the fraction of $C_5$ and less was 57% by volume and the proportion of the fraction of $C_9$ and more was 40% by volume. With respect to the hydrocarbon composition of the distillate, the content of aromatics was 39% by volume.

This gasoline-blended methanol fuel was evaluated for its low temperature starting-improving effect and flame visibility-improving effect. Although a certain degree of improvement was observed for each item, the fuel prepared above was less effective than the gasoline-blended methanol fuels according to the present invention.

COMPARATIVE EXAMPLE 6

An ordinary automotive gasoline (regular gasoline on the market) was mixed in an amount of 35% by volume with the catalytically reformed gasoline distillate obtained in Example 1, to prepare a gasoline distillate. This gasoline distillate was blended with methanol in a proportion of 15% by volume.

The gasoline distillate used for preparing the gasoline-blended methanol fuel had fraction proportions such that the proportion of the fraction of $C_5$ and less was 45% by volume and the proportion of the fraction of $C_9$ and more was 33% by volume. With respect to the hydrocarbon composition of the distillate, the content of aromatics was 36% by volume.

This gasoline-blended methanol fuel was evaluated for its low temperature starting-improving effect and flame visibility-improving effect. Although a certain degree of improvement was observed for each item, the fuel prepared above was less effective than the gasoline-blended methanol fuels according to the present invention.

TABLE 1

| | Example | | | | | |
|---|---|---|---|---|---|---|
| | 1 | 2 | 3 | 4 | 5 | 6 |
| Base ingredients | | | | | | |
| Methanol, vol % | 85 | 85 | 85 | 88 | 70 | 85 |
| Catalytically reformed gasoline fraction (1), vol % | 9.00 (60) | 5.25 (35) | 12.75 (85) | 7.20 (60) | 18.00 (60) | 6.75 (60) |
| Catalytically reformed gasoline fraction (3), vol % | 6.00 (40) | 9.75 (65) | 2.25 (15) | 4.80 (40) | 12.00 (40) | 4.50 (40) |
| Ordinary automotive gasoline base, vol % | — | — | — | — | — | 11.25 (75) / 3.75 (25) |
| Contents in whole gasoline | | | | | | |
| Fraction of $C_5$ and less, vol % | 57 | 33 | 81 | 57 | 57 | 49 |
| Fraction of $C_{6-8}$, vol % | 3 | 2 | 4 | 3 | 3 | 16 |
| Fraction of $C_9$ and more, vol % | 40 | 65 | 15 | 40 | 40 | 35 |
| Aromatics, vol % | 39 | 63 | 15 | 39 | 39 | 37 |
| Low temperature starting-improving effect (a) | ◎ | ○ | ◎ | ◎ | ◎ | ◎ |
| Flame visability-improving effect (b) | ◎ | ◎ | ○ | ◎ | ◎ | ◎ |

TABLE 2

| | Comparative Example | | | | | |
|---|---|---|---|---|---|---|
| | 1 | 2 | 3 | 4 | 5 | 6 |
| Base ingredients | | | | | | |
| Methanol, vol % | 85 | 85 | 85 | 85 | 92 | 85 |
| Catalytically reformed gasoline fraction (1), vol % | — | — | 3.75 (25) | 14.25 (95) | 4.80 (60) | 5.85 (60) |
| Catalytically reformed gasoline fraction (3), vol % | — | — | 11.25 (75) | 0.75 (5) | 3.20 (40) | 3.90 (40) |
| Ordinary automotive gasoline base, vol % | 15 | — | — | — | — | 9.75 (65) / 5.25 (35) |
| Straight-run light naphtha, vol % | — | 15 | — | — | — | — |
| Contents in whole gasoline | | | | | | |

TABLE 2-continued

| | Comparative Example | | | | | |
|---|---|---|---|---|---|---|
| | 1 | 2 | 3 | 4 | 5 | 6 |
| Fraction of $C_5$ and less, vol % | 23 | 42 | 24 | 90 | 57 | 45 |
| Fraction of $C_{6-8}$, vol % | 56 | 57 | 1 | 5 | 3 | 22 |
| Fraction of $C_9$ and more, vol % | 21 | 1 | 75 | 5 | 40 | 33 |
| Aromatics, vol % | 29 | 7 | 73 | 5 | 39 | 35 |
| Low temperature starting-improving effect (a) | ○ | ◎ | Δ | ◎ | ○ | ○ |
| Flame visability-improving effect (b) | ○ | Δ | ◎ | X | ○ | ○ |

In both tables, the uppermost section shows the proportions of base ingredients in the production of each methanol fuel. Figures in parentheses show the percentage of each gasoline fraction by volume based on whole gasoline fractions. The intermediate section shows the distribution of the above-described three fractions and the content of aromatics in each gasoline blended with methanol. The lowermost section shows evaluation results for each fuel.

Regarding the evaluation results, the low temperature starting-improving effect (a) was evaluated by a test in which a 2.0 L engine which had been altered so as to be suitable for methanol was installed in a low temperature testing room. The temperature at which each fuel was able to start the engine by 10-second cranking was measured. Fuels for which this temperature is below −15° C. are shown by ◎, those between −15° C. and −5° C. by ○, those between −5° C. and 5° C. by Δ, and those of 5° C. or more by x.

With respect to the flame visibility-improving effect (b), evaluation was made by a test in which 10 ml of each fuel was placed in a laboratory dish made of glass which had a diameter of 10 cm and a height of 2 cm. Flame visibility was visually examined in a well-lighted room. Fuels whose flames were fully visible until burning out are shown by ◎, fuels whose flames were visible until burning out are shown by ○, fuels whose flames were visible for a short time after firing but become less visible thereafter are shown by Δ, and fuels whose flames were visible for a short time after firing but become invisible thereafter or whose flames were invisible from the beginning are shown by x.

Among the Comparative Examples shown in Table 2, the fuel of Comparative Example 1 was one obtained by blending an ordinary automotive gasoline (regular gasoline on the market) with methanol in a proportion of 15% by volume and is widely used as a methanol fuel. The fuel of Comparative Example 2 was one which has been obtained by blending a straight-run light naphtha with methanol in a proportion of 15% by volume and is only occasionally used as a methanol fuel.

While the invention has been described in detail and with reference to specific embodiments thereof, it will be apparent to one skilled in the art that various changes and modifications can be made therein without departing from the spirit and scope thereof.

What is claimed is:

1. A fuel for Otto cycle internal combustion engines, which comprises, a blend of a gasoline (A) and methanol (B) in a ratio of 10:90 to 30:70 by volume, based on the total amount of (A) and (B), wherein said gasoline (A) is obtained by the steps of, (i) hydrotreating heavy naphtha, (ii) catalytically reforming the hydrotreated heavy naphtha to obtain a catalytically reformed gasoline, (iii) distilling the reformed gasoline to divide said reformed gasoline into three fractions (1), (2) and (3) which fractions contain hydrocarbons having a carbon number of 5 and less, from 6 to 8, and 9 and more, respectively, and (iv) mixing the two fractions of (1) and (3) either in a ratio which is the same as that in which the two fractions were obtained by the distillation or in a ratio of 30:70 to 90:10 based on the total volume amount of (1) and (3).

2. A fuel for Otto cycle internal combustion engines, which comprises, a blend of a gasoline (A′) and methanol (B) in a ratio of 10:90 to 30:70, wherein said gasoline (A′) is obtained by mixing an ordinary automotive gasoline base with the gasoline (A) as specified in claim 1 in a proportion of 30:70 by volume or less based on the total volume amount of blend (A′).

3. A fuel for Otto cycle internal combustion engines, which comprises, a blend of a gasoline (A) and methanol (B) in a ratio of 15:85 by volume, based on the total volume amount of (A) and (B), wherein said gasoline (A) is obtained by the steps of, (i), (ii) and (iii) as specified in claim 1, and (iv) mixing the two fractions of (1) and (3) in a ratio of 60:40 based on the total volume amount of (1) and (3).

* * * * *